US008567513B2

(12) United States Patent
Lacheny et al.

(10) Patent No.: US 8,567,513 B2
(45) Date of Patent: Oct. 29, 2013

(54) HYDRAULIC SURFACE CONNECTOR

(75) Inventors: Michael A. Lacheny, Magnolia, TX (US); Wassee Syed, Houston, TX (US); Saurabh Kajaria, Houston, TX (US)

(73) Assignee: T-3 Property Holdings, Inc., Houston, TX (US)

( * ) Notice: Subject to any disclaimer, the term of this patent is extended or adjusted under 35 U.S.C. 154(b) by 285 days.

(21) Appl. No.: 13/098,008

(22) Filed: Apr. 29, 2011

(65) Prior Publication Data

US 2011/0266006 A1 Nov. 3, 2011

Related U.S. Application Data

(60) Provisional application No. 61/330,231, filed on Apr. 30, 2010.

(51) Int. Cl.
*E21B 19/00* (2006.01)

(52) U.S. Cl.
USPC ..... 166/379; 166/97.5; 166/345; 285/305; 285/335

(58) Field of Classification Search
USPC ..... 166/379, 97.5, 345, 368; 285/91, 113, 285/305, 335; 348/125, 329; 251/1.1, 1.3
See application file for complete search history.

(56) References Cited

U.S. PATENT DOCUMENTS

| | | | | |
|---|---|---|---|---|
| 4,188,050 | A | | 2/1980 | Lochte |
| 4,350,371 | A | | 9/1982 | Lochte et al. |
| 4,519,633 | A | | 5/1985 | Nichols |
| 4,606,557 | A | | 8/1986 | Coffey |
| 4,838,623 | A | | 6/1989 | Mineart |
| 4,867,483 | A | | 9/1989 | Witt et al. |
| 4,927,192 | A | | 5/1990 | Ungchusri et al. |
| 4,993,488 | A | * | 2/1991 | McLeod ..... 166/72 |
| 5,131,692 | A | | 7/1992 | Lemons |
| 5,259,459 | A | | 11/1993 | Valka |
| 5,775,427 | A | | 7/1998 | Skeels et al. |
| 6,481,504 | B1 | | 11/2002 | Gatherar |
| 6,666,272 | B2 | | 12/2003 | Singeetham et al. |

* cited by examiner

*Primary Examiner* — Yong-Suk (Philip) Ro
(74) *Attorney, Agent, or Firm* — Locke Lord LLP

(57) ABSTRACT

A connector to secure a blow out preventer to a casing head of a well or wellhead or other tubing and a method of securing a blow out preventer to the well tubing utilizing the connector. The connector may be configured to secure the blow out preventer adapter to the well tubing and provide, within fifteen minutes, a seal operable to withstand ten thousand pounds per square inch of pressure. The connector may include both a hydraulically operated locking segment and a separate mechanical locking segment, and wherein both locking segments may be transitioned from a fully retracted position to a fully locked position within fifteen minutes. The connector may be configured to accommodate up to ten degrees of misalignment between the blow out preventer and the tubing.

10 Claims, 14 Drawing Sheets

HYDRAULIC SURFACE CONNECTOR

CROSS REFERENCE TO RELATED APPLICATIONS

This application is a non-provisional application, and claims priority benefit, of U.S. Provisional Application 61/330,231, filed Apr. 30, 2010, which is incorporated herein by specific reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to connectors for connecting components of a well; and more specifically relate to connecting a blowout preventer to a surface well casing head at the surface.

2. Description of the Related Art

U.S. Pat. No. 4,188,050 discloses a "remotely controllable connector for releasably interconnecting the ends of two oil well flowlines. The connector comprises two coupling members, one of which is extended into engagement with the other by actuation of fluid cylinders, and ball joints in one or both coupling members to accommodate misalignment of the flowlines. A pair of mating cones mounted on the opposed ends of the two coupling members align the members into proper position during the connecting operation, and clamp means that are activated by remote control secure the two coupling members together in a fluid-tight connection. Seals are then set by remote control to seal all joints and to lock the coupling members in working alignment."

U.S. Pat. No. 4,350,371 discloses a "pipe connector especially adapted for connecting subsea pipes includes a dart-shaped assembly that can be installed and sealed in a cylindrical housing to establish a fluid-tight connection between the assembly and the housing using a minimum of diver assistance. The connector housing includes an axial passage to receive the assembly, and an annular groove in the inner wall of the axial passage. The assembly includes a bore extending axially from one end thereof through a portion of the assembly, and a port extending radially from the axial bore through the wall of the assembly to the groove of the housing when the assembly is positioned in the housing. Another passage extends radially from the groove to the outside of the housing. A pair of annular resilient packing rings mounted between the assembly and the housing provide fluid-tight seals for fluid flow from the axial bore of the assembly through the radial port and the annular groove out through the radial passage in the housing. Means are provided for selectively locking and unlocking the assembly in the housing and for setting and releasing the resilient packing rings."

U.S. Pat. No. 4,519,633 discloses a "pipe connector especially useful in tying back to a subsea wellhead with a marine riser. The connector comprises a body or sub, a collar surrounding the sub and carrying anti-rotation keys and a lock ring, and an actuator nut surrounding and threaded to the sub. The anti-rotation keys prevent rotation of the collar and the nut with respect to the receptacle into which the connector is run, and rotation of the sub with respect to the collar and nut locks the connector into the receptacle and establishes a metal-to-metal seal therewith."

U.S. Pat. No. 4,606,557 discloses a "pipe connector especially suitable for interconnecting a marine riser to a subsea wellhead, the connector comprising an annular body that telescopes over the wellhead, and a plurality of lockdown screw assemblies extending through radial ports in the body to releasably grip and secure the connector to the wellhead. Each screw assembly comprises a lockdown dog for engaging the recess beneath the wellhead hub flange, a bolt-like dog retainer secured to the dog and slidably extending into a lockdown screw that is threaded into one of the radial ports, and a spring system for biasing the dog away from the lockdown screw towards engagement with the wellhead."

U.S. Pat. No. 4,838,623 discloses a "end connector for double-pin track shoes or the like receives a pair of pins having arcuate grooves therein. The connector includes pin receiving openings having small diameter pin engaging arcuate surfaces, and large diameter arcuate grooves therebetween which nest arcuate portions of a spring therein. The spring also includes resiliently stressed portions that snap into the arcuate grooves in the pins when assembled, and a cap screw operatively connected between two walls of the connector clamps the connector onto the pins, thus providing double protection for maintaining the connector on the pins."

U.S. Pat. No. 4,867,483 discloses a "pipe connector device for interconnecting first and second pipe elements using a retention member removably secured to the first pipe element by load elements. The retention member is secured to the second pipe element by pipe threads or a second retention member can be secured to the second pipe element by load elements and the first and second retention members threaded together. A seal is extended along a portion of the length of the first and second pipe elements adjacent to an end portion of each of the pipe elements to prevent leakage. This provides a fluid-tight seal which is relatively independent of any pressure exerted between the first and second pipe elements by the retention member."

U.S. Pat. No. 4,927,192 discloses a "pipe connector load element interconnects a pipe element and a connector retention member. The load element is mounted in an annular groove on the outer circumference of the pipe element and in a groove adjacent to an internal bore in the retention member to secure the retention member to the pipe element. The load element includes a plurality of elongated components each having a slot extending lengthwise, and a flexible ribbon for threading through the slots. A pair of retention members are interconnected to connect a pair of pipe elements in an end-to-end arrangement."

U.S. Pat. No. 5,131,692 discloses a "pipe connector device for selectively interconnecting a pair of pipe elements in an end-to-end relationship and for sealing a junction between the elements to prevent leaks. A first and a second pipe element each includes a cavity adjacent to a center bore in the pipe element. The first pipe element has a substantially smooth inner surface which defines an outer boundary of a first cavity. An annular seal mounted in the cavities seal the junction between the pipe elements. A threaded outer portion of the seal has a plurality of radially outer points which press against the inner surface of the first cavity to retain the annular seal in the first cavity when the pipe elements are separated."

U.S. Pat. No. 5,259,459 discloses a "subsea wellhead tie-back connector actuated solely by axial motion to achieve connection to and disconnection from the wellhead. The connector includes interconnected inner and outer bodies, a split lock ring surrounding the inner body, and an energizing mandrel for non-rotary axial movement to expand the lock ring into engagement with a wellhead component."

U.S. Pat. No. 5,775,427 discloses a "subsea wellhead tieback connector operatively used to connect to a marine riser pipe or a well conductor in a manner that that will not unthread or unloosen the joints of the riser pipe being unlocked. The tieback connector operates with a novel internal latching mechanism having a hydraulic piston, an inner body that stretches and deflects in a unique manner resulting in compression spring forces at two locations, an expanding lock ring, a threaded adjustment ring, and a reaction ring. During operation the tieback connector creates an enhanced mechanical advantage to originate a required pre-load force without the necessity of having to generate a large hydraulic force that would otherwise be needed."

U.S. Pat. No. 6,481,504 discloses a "flowline connector having a first connector portion for mounting on a first piece of subsea equipment, such as a wellhead. A second connector portion of the flowline connector is attached to an end portion of a flowline. Each connector portion has a respective guide interengageable by lowering the second connector portion, on the end portion of the flowline, into the first connector portion. The guides allow the second connector portion to pivot relative to the first connector portion to bring the first connector portion and the second connector portion into axial alignment for make-up of a fluid tight connection therebetween. The second connector portion has a subsea equipment package, for example chokes, gas/water separators, gas liquifiers, pumps and the like, for connection to the first piece of the subsea equipment."

U.S. Pat. No. 6,666,272 discloses an "externally actuatable tieback connector for establishing fluid communication and force resisting connection of a conduit to a subsea wellhead having an internal locking geometry. The tieback connector has a body structure that is adapted for landing on a wellhead, with a part thereof extending into the wellhead and carrying a split lock ring. A lock energizing element, moveable relative to the body structure, has a locking position expanding the lock ring into locking and pre-load force transmitting engagement with the internal locking geometry of the wellhead and an unlocking position releasing the tieback connector from the wellhead. One or more drive members extend from the lock energizing element and are exposed externally of the connector body and wellhead for engagement and actuating movement by a lock actuating tool such as a ROV or the like."

The inventions disclosed and taught herein are directed to [an improved system for connecting a blowout preventer to a surface well casing head at the surface.

BRIEF SUMMARY OF THE INVENTION

The present invention comprises a connector to secure a blow out preventer to tubing or casing head of a well or wellhead (referenced herein as "tubing" of a well). The connector may include an adapter configured to be secured to the blow out preventer. The connector may be configured to secure the adapter to the tubing and provide, within fifteen minutes, a seal operable to withstand ten thousand pounds per square inch of pressure. The connector may include both a hydraulically operated locking segment and a separate mechanical locking segment, and wherein both locking segments may be transitioned from a fully retracted position to a fully locked position within fifteen minutes. The blow out preventer, the tubing, and the connector may be located, and the locking segments may be operated, above sea level. The mechanical locking segment may manually, semi-, or fully-automatically retain the hydraulically operated locking segment in the fully locked position. The hydraulically operated locking segment may be configured to remain in the fully locked position once hydraulic pressure is decreased. The seal may be a metal to metal seal. The seal may include two metal ring gaskets, at least one of which is configured to fit in an American Petroleum Institute R-54 ring groove in a top surface of the tubing. The connector may be configured to accommodate up to ten degrees of misalignment between the blow out preventer and the tubing. The connector may include a load ring configured to be threaded, welded, integral to, or otherwise secured onto the tubing. The load ring may provide a shoulder at a distal end of the tubing, and the hydraulically operated locking segment may engage the shoulder to provide the seal. The hydraulically operated locking segment may include a tubular piston that moves longitudinally between the fully retracted position and the fully locked position and a plurality of wedges positioned around the piston, such that longitudinal movement of the piston drives the wedges radially inward to engage the shoulder, thereby providing the seal.

The present invention also comprises a method of securing a blow out preventer to tubing. The method may comprise lowering a connector connected to the blow out preventer onto the tubing, pressurizing a hydraulically operated locking segment of the connector, thereby causing the hydraulically operated locking segment to move from a fully retracted position to a fully locked position, and thereby providing a seal between the blow out preventer and the tubing, and retaining the hydraulically operated locking segment in the fully locked position utilizing a separate mechanical locking segment. The entire process may be completed within fifteen minutes. The entire process may be performed above sea level. The seal may be a metal to metal seal capable of withstanding ten thousand pounds per square inch of pressure.

DETAILED DESCRIPTION OF THE INVENTION

Figure 1:
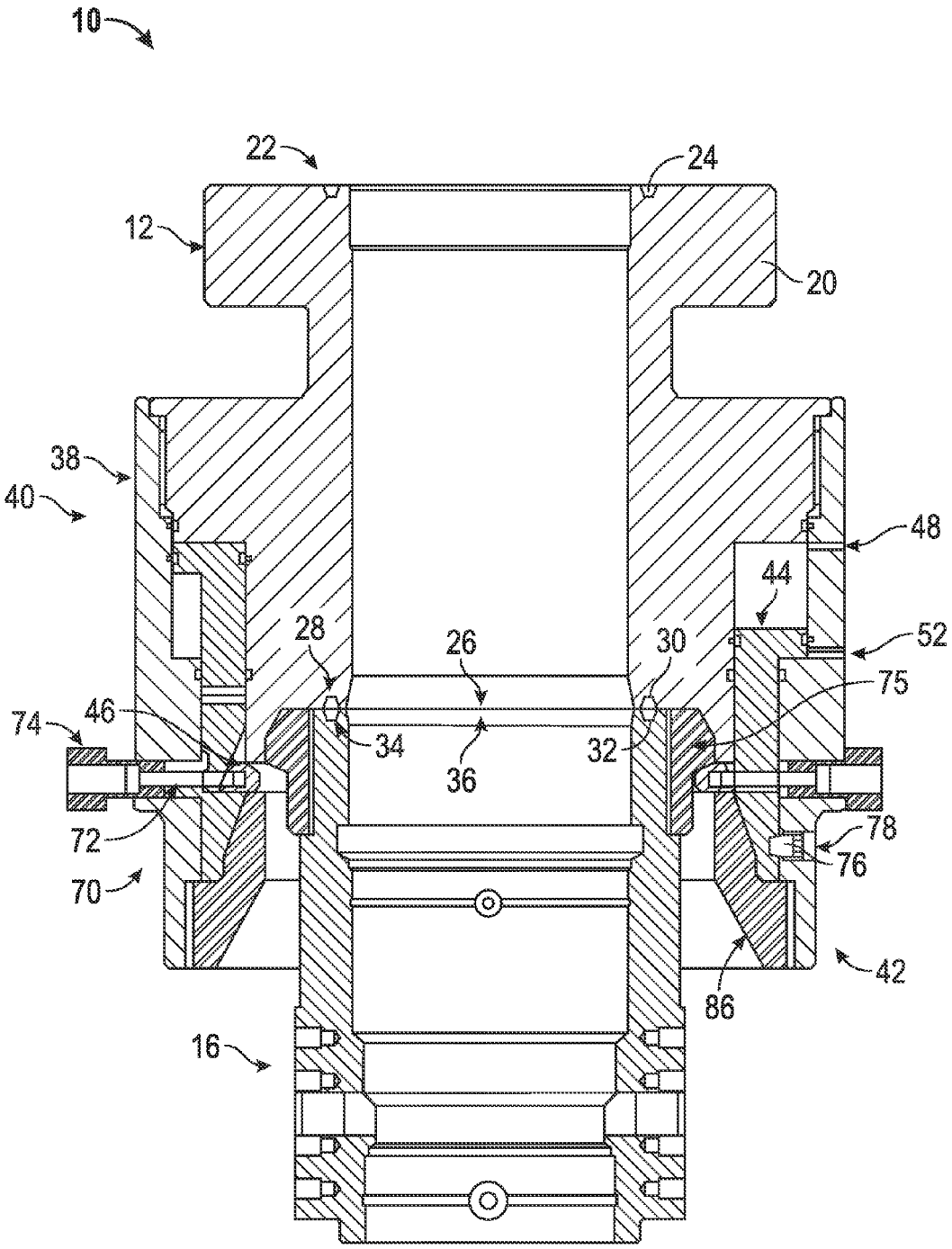
FIG. 1 illustrates a sectional view of a particular embodiment of a hydraulic surface connector utilizing certain aspects of the present inventions.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicants have created a connector to secure a blow out preventer to tubing and a method of securing a blow out preventer to tubing utilizing the connector. The connector may include an adapter configured to be secured to the blow out preventer. The connector may be configured to secure the adapter to the tubing and provide, within fifteen minutes, a seal operable to withstand ten thousand pounds per square inch of pressure. The connector may include both a hydraulically operated locking segment and a separate mechanical locking segment, and wherein both locking segments may be transitioned from a fully retracted position to a fully locked position within fifteen minutes. The blow out preventer, the tubing, and the connector may be located, and the locking segments may be operated, above sea level. The mechanical locking segment may manually, semi-, or fully-automatically retain the hydraulically operated locking segment in the fully locked position. The hydraulically operated locking segment may be configured to remain in the fully locked position once hydraulic pressure is decreased. The seal may be a metal to metal seal. The seal may include two metal ring gaskets, at least one of which is configured to fit in an American Petroleum Institute R-54 ring groove in a top surface of the tubing. The connector may be configured to accommodate up to ten degrees of misalignment between the blow out preventer and the tubing. The connector may include a load ring configured to be threaded, welded, integral to, or otherwise secured onto the tubing. The load ring may providing a shoulder at a distal end of the tubing, and the hydraulically operated locking segment may engage the shoulder to provide the seal. The hydraulically operated locking segment may include a tubular piston that moves longitudinally between the fully retracted position and the fully locked position and a plurality of wedges positioned around the piston, such that longitudinal movement of the piston drives the wedges radially inward to engage the shoulder, thereby providing the seal.

Figure 2:
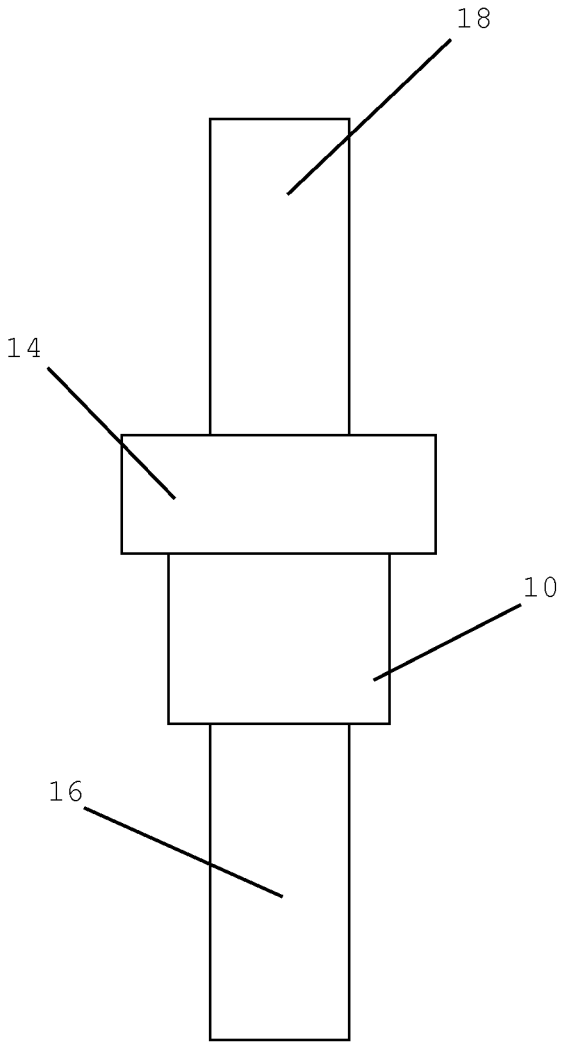
FIG. 2 illustrates an elevation view of a wellhead connected to production tubing through a blow out preventer and the connector of the present inventions.

FIG. 1 is an illustration of a connector 10 according to certain aspects of the present inventions. In one embodiment, the connector 10 includes an adapter 12 that may be bolted, or otherwise secured, to a blow out preventer (BOP) 14, shown in FIG. 2. The connector 10 is primarily designed to secure the BOP 14 to a casing head, or some other section of tubing 16, of a well, such as an oil and/or natural gas well. As also shown in FIG. 2, additional production components 18, such as a valve assembly commonly referred to as a Christmas Tree, are expected to be connected above the BOP 14.

As mentioned above, the connector 10 may include the adapter 12 that mates to the BOP 14. The adapter 12 may be generally tubular and include an upper flange 20 and/or one or more upper ring grooves 22 to receive a ring gasket 24 therein, to seal the adapter 12 to the BOP 14. The adapter 12 also preferably includes a planar adapter mating surface 26 and/or one or more mating ring grooves 28 to receive a mating gasket 30 therein, to seal the adapter 12 to the tubing 16, of the well. The mating ring grooves 28 may conform to the American Petroleum Institute R-54 standard. The mating gasket 30 may at least partially fit within the mating ring groove 28 and may be partially crushed by operation of the connector 10 to provide a seal between the adapter 12 and the tubing 16 operable to withstand ten thousand pounds per square inch of pressure. The mating gasket 30 may be constructed of metal to provide a metal to metal seal between the adapter 12 and the tubing 16. More specifically, the mating gasket 30 preferably forms the seal by being crushed against a well gasket 32 partially recessed within a well ring groove 34 of a planar well mating surface 36.

Figure 3:
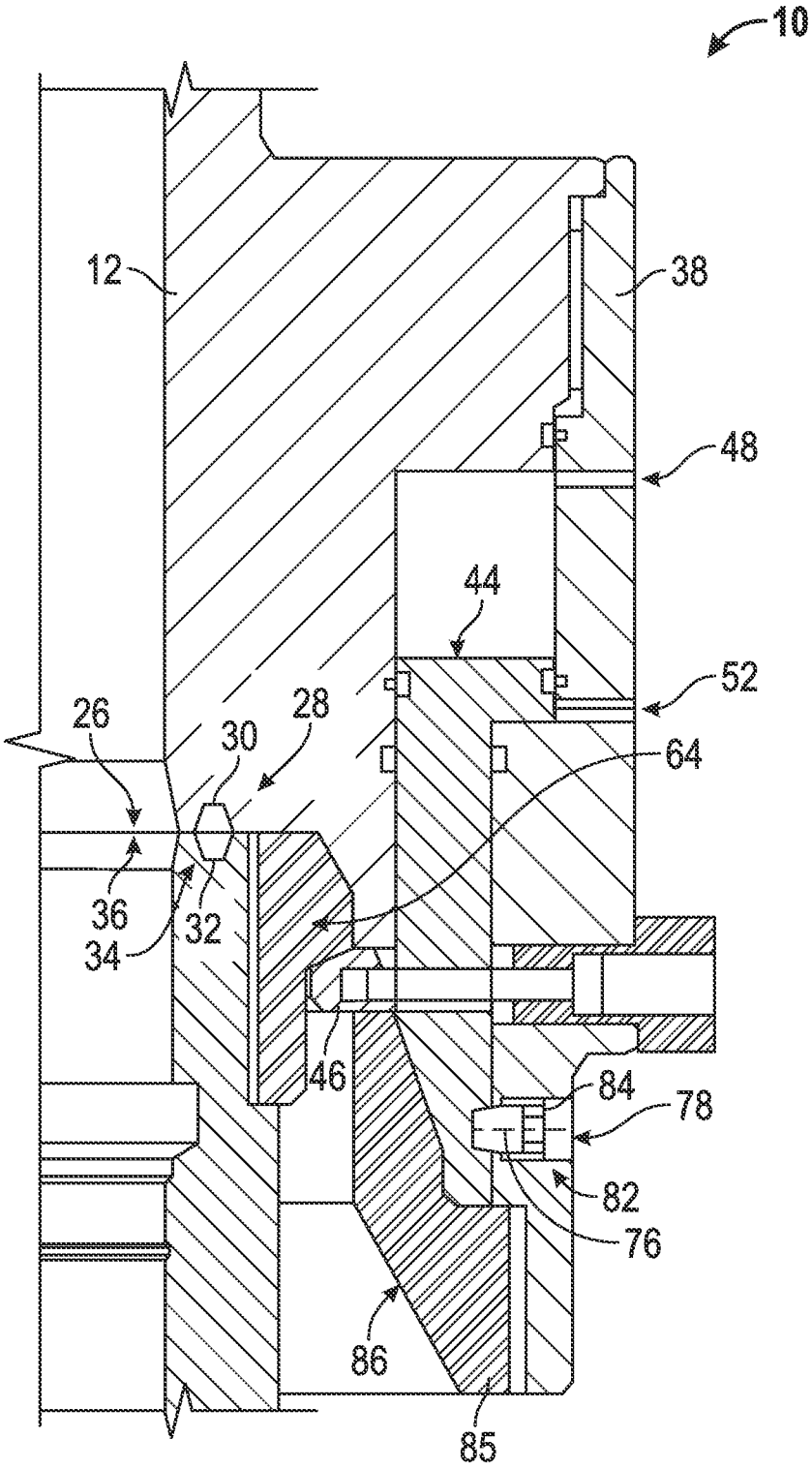
FIG. 3 illustrates a close up view of a select portion of FIG. 1.

Referring also the FIG. 3, the adapter 12 may be at least partially surrounded by an outer housing 38 around the circumference of the connector 10. The outer housing 38 preferably houses both a hydraulically operated locking segment 40 and a separate mechanical locking segment 42.

Figure 4:
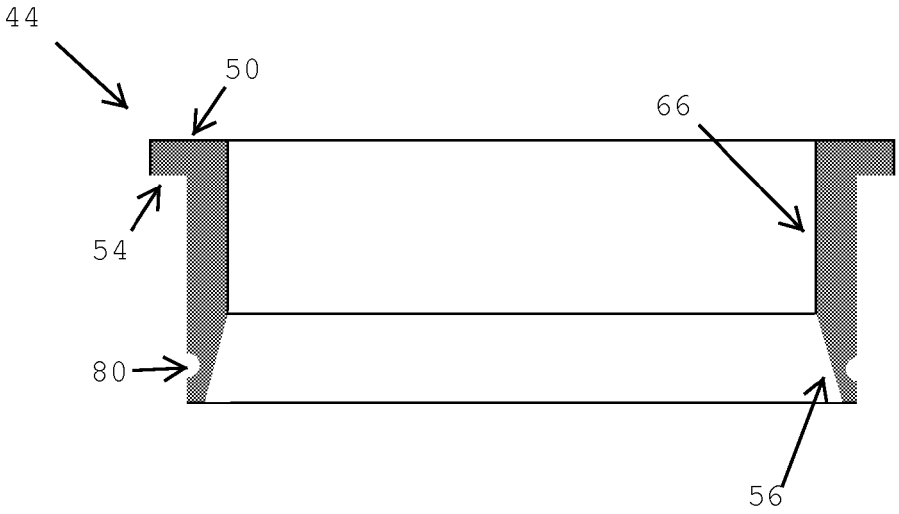
FIG. 4 illustrates a simplified sectional view of a tubular piston utilizing certain aspects of the present inventions.
Figure 5:
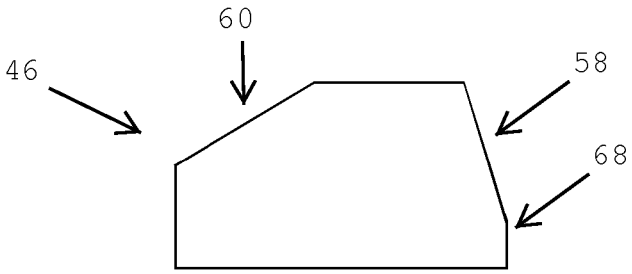
FIG. 5 illustrates a simplified sectional view of a wedge utilizing certain aspects of the present inventions.
Figure 6:
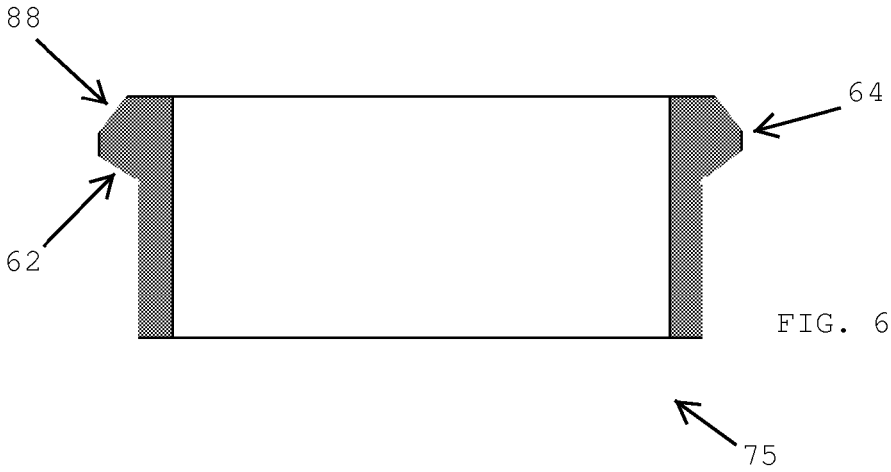
FIG. 6 illustrates a simplified sectional view of a load ring utilizing certain aspects of the present inventions.
Figure 7:
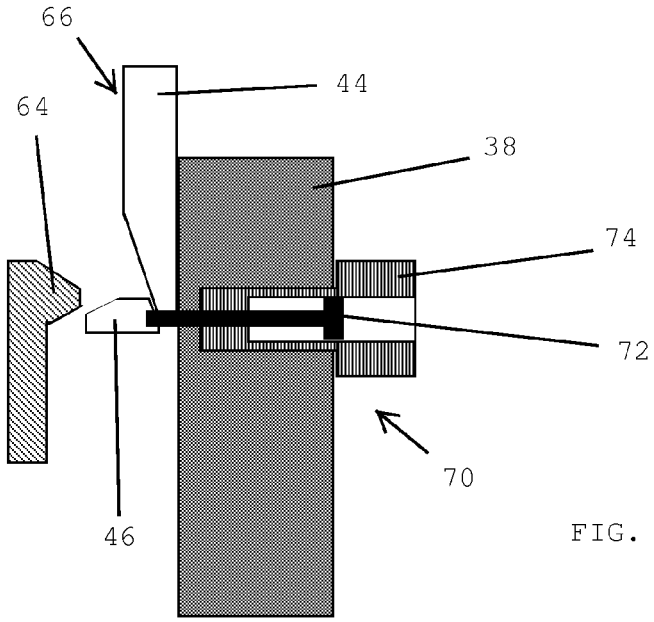
FIG. 7 illustrates a simplified sectional view of select portions of the present inventions, shown in a unlocked position.
Figure 8:
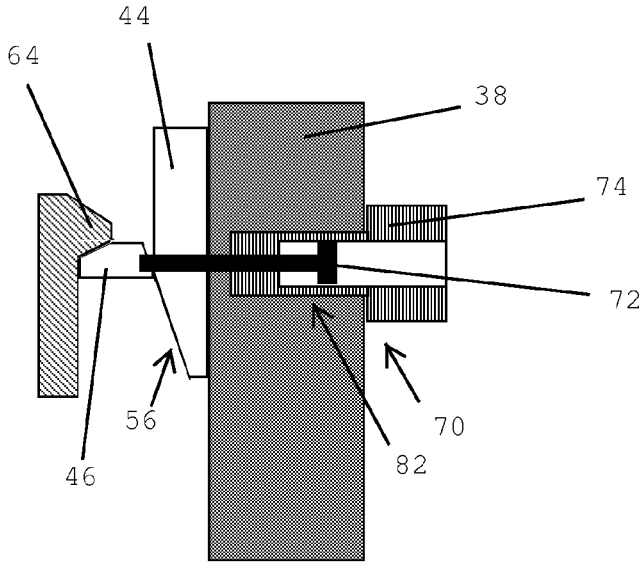
FIG. 8 illustrates a simplified sectional view of select portions of the present inventions, shown in a locked position.

Referring also to FIGS. 4-6, the hydraulically operated locking segment 40 may include a tubular piston 44 that moves longitudinally between a fully retracted position, as shown in FIG. 7, and a fully locked position, as shown in FIG. 8, and a plurality of wedges 46 positioned around the piston 44. Longitudinal movement of the piston 44 may drive the wedges 46 radially inward to engage a shoulder 64 of the well tubing 16, thereby clamping the adapter 12 to the well tubing 16 and partially crushing the gaskets 30,34 together providing the seal.

More specifically, as pressurized hydraulic fluid is injected into a locking port 48 of the outer housing 38, thereby pressurizing the hydraulically operated locking segment 40, that pressure is applied to a locking surface 50 of the piston 44. In one embodiment, the locking surface 50 is an upper annular surface. This hydraulic pressure pushes against the locking surface 50, driving the piston 44 from the fully retracted position, as shown in FIG. 7, to the fully locked position, as shown in FIG. 8. Alternatively, the pressurized hydraulic fluid may be injected into an unlocking port 52 of the outer housing 38 to push against an unlocking surface 54 of the piston 44, driving the piston 44 away from the fully locked position, as shown in FIG. 8, and toward the fully retracted position, as shown in FIG. 7. To contain the pressurized hydraulic fluid, there are preferably seals between the piston 44 and the adapter 12 and/or the outer housing 38, as shown in FIG. 1 and FIG. 3.

In any case, as the piston 44 is driven from the fully retracted position toward the fully locked position, an inner sloping surface 56 of the piston 44 slidably engages an outer sloping surface 58 of the wedges 46, thereby driving the wedges 46 radially inward. As the wedges 46 are driven radially inward, inner angled surfaces 60 of the wedges 46 slidably engage an outer angled surface 62 forming a shoulder 64 of the well tubing 16. When the piston 44 has reached the fully locked position, the inner sloping surface 56 of the piston 44 may have moved past the outer sloping surface 58 of the wedges 46, such that a longitudinally flat inner surface 66 of the piston then engages longitudinally flat outer surfaces 68 of the wedges 46.

More specifically, the longitudinally flat inner surface 66 and the longitudinally flat outer surfaces 68 are preferably generally flat, when compared to the inner sloping surface 56 and the outer sloping surface 58, respectfully. However, as previously mentioned, the piston 44 may be tubular, and therefore the longitudinally flat inner surface 66 and the longitudinally flat outer surfaces 68 might only be flat longitudinally, such as along a Y axis, but be curved with respect to other axis, such as along an X-Z plane. In any case, because the piston 44 is configured to move longitudinally, and in the fully locked position, the piston 44 may engage the wedges 46 with longitudinally flat surfaces 66,68, outward force exerted on the wedges 46 will not tend to move the piston 44, thereby allowing the hydraulically operated locking segment 40 to remain in the fully locked position even with a reduction or complete loss of hydraulic pressure.

Of course, the pressurized hydraulic fluid may still be injected into the unlocking port 52 to drive the piston 44 away from the fully locked position, if desired. However, because of the pressures involved, the wedges 46 may tend to stay fully engaged with the shoulder 64. This may be the case where the angles of the inner angled surfaces 60 of the wedges 46 and the outer angled surface 62 of the shoulder 64 are especially shallow. Therefore, the hydraulically operated locking segment 40 may also include a manually or hydraulically operated release 70. In one embodiment, the release 70 includes a retracting bolt 72 secured to each wedge 46 and a retracting nut 74 surrounding each retracting bolt 72. The retracting nut 74 may be threaded into the outer housing 38, such that unscrewing the retracting nut 74 pulls on a head of the retracting bolt 72, thereby pulling the wedge 46 radially outward.

The shoulder 64 may be integral to a distal end of the well tubing 16. Alternatively, the shoulder 64 may be formed onto a load ring 75 that may be threaded, welded, or otherwise secured to the distal end of the well tubing 16.

The mechanical locking segment 42 may include one or more retaining pins 76 and retaining nuts 78. The retaining pins 76 may be configured to slide into one or more recesses 80 in the piston 44, when the piston 44 is in the fully locked position. The retaining pins 76 may be slidably retained in one or more pockets 82 of the outer housing 38 and held in place, and/or forced against the piston 44, by the retaining nuts 78.

In certain applications, the mechanical locking segment 42 may be configured to operate automatically. For example, the mechanical locking segment 42 may include one or more resilient members 84, such as a spring, between the retaining pins 76 and the retaining nuts 78. This resilient members 84 may allow the retaining pins 76 to slide radially outwardly and into the pocket 82 of the outer housing 38 when the piston 44 begins to pass by until the recess 80 in the piston 44 is aligned with the retaining pins 76, in which case the resilient member 84 pushes the retaining pins 76 radially inward to engage the recess 80 in the piston 44, thereby locking both the hydraulically operated locking segment 40 and the mechanical locking segment 42 in the fully locked position.

The connector 10 may also be configured to accommodate up to ten degrees of misalignment between the BOP 14 and the well tubing 16. For example, the BOP 14 center of gravity is not always perfectly in the vertical plane. In some cases, the BOP 14 may be at an angle of up to ten degrees from vertical. With the well tubing 16 preferably being vertical, the BOP 14 and the well tubing 16 may be misaligned by up to ten degrees.

To aid in accommodating this, in one embodiment, the connector 10 includes a guide funnel 85 to guide a lower end of the connector 10 onto the well tubing 16. The guide funnel 85 may include a lower sloped surface 86 which engages an upper sloped surface 88 of the load ring 75, or shoulder 64. As the connector 10, connected to the BOP 14, is lowered onto the well tubing 16, the lower sloped surface 86 engages the upper sloped surface 88, thereby guiding the connector 10 onto and around the well tubing 16. When the load ring 75, the shoulder 64, or the well tubing 16 meets the adapter 12, then connector 10 begins to align the adapter 12, the BOP 14, and the well tubing 16. Once the connector 10 and the BOP 14 are resting atop the well tubing 16, the BOP 14 will be aligned with the tubing 16.

Thus, the connector 10 of the present invention may greatly speed up the time it would otherwise take to connect the BOP 14 to the well tubing 16. More specifically, it should take no longer than fifteen minutes from the time the load ring 75 is secured to the well tubing 16 until both the hydraulically operated locking segment 40 and the mechanical locking segment 42 are in the fully locked position. In some cases, it may take no longer than fifteen minutes from the time the connector 10 beings to be lowered onto the well tubing 16 until both the hydraulically operated locking segment 40 and the mechanical locking segment 42 are in the fully locked position, thereby providing the seal, such as a metal to metal seal capable of withstanding ten thousand pounds per square inch of pressure. In some cases, it may take no longer than fifteen minutes to secure the shoulder 64 to the well tubing and complete the connection between the BOP 14 and the well tubing 16. With a trained and experienced crew, any or all these times may be reduced to twelve minutes, or even ten minutes.

Hydraulic connectors may be used to secure production risers, pipelines, and subsea casing heads, wellheads, and other tubing. On the surface, or above sea level, mechanical connectors are typically used, such as locking pins or segmented clamps. Using typical mechanical methods may extend beyond the required time span, such as the fifteen minutes mentioned above. So, the connector 10 of the present invention provides the hydraulically operated locking segment 40 and the mechanical locking segment 42, which may be manually operated, semi- or fully-automatic, to expedite the connection between the BOP 14 and the well tubing 16, with connector 10, the BOP 14, and the well tubing 16 all being on the surface, or above sea level.

As the connector is slowly lowered, the guide funnel properly orients the connector and BOP back to the true vertical position. The connector may include an outer housing, piston, guide funnel, lock segments, threaded load ring, BOP adapter, retaining nut and pin, and retracting nuts and bolts. The outer housing allows internal pressure to be applied to the piston to lock and unlock the connector.

To lock the connector, hydraulic pressure is applied to the lock, or locking, port. The piston will travel downward (vertically) engaging several wedges that are otherwise loosely resting in a static position. As the piston continues to travel downward (vertically), the wedges travel inward (radially) reacting against the taper, or inner sloping surface, of the piston. The wedges then begin to react with the load ring that is installed onto the casing head, which generates a crushing/squeezing force in order to get a metal-to-metal seal.

This crushing/squeezing force may be required for the metal-to-metal seal engagement to be rated to ten thousand pounds per square inch of pressure, or more. The metal-to-metal seal may be provided by a custom ring gasket fitted in an API R-54 ring groove. The R-54 ring groove also allows the connector to makeup to a five thousand pounds per square inch tubing head assembly.

Once the piston is fully stroked into the locked position, the piston and wedges form a flat to flat bearing surface. This flat to flat will not allow the connector to unlock once the hydraulic pressure is bled off from the system, by translating any axial/tension load to a radial/hoop load.

As a secondary safety measure to ensure the piston does not travel upward and unlock, a spring loaded or mechanical retaining pin and retaining nut may be utilized that engages in a groove, or recess, on the piston once the piston is at full stroke. The retaining pin and retaining nut may provide a set designed force that may ensure that if the piston does experience any axial/tension force, the retaining pin will not allow the piston to travel upward and unlock the connector during service.

To release/unlock the connector, pressure may be applied to the unlock port which may stroke the piston upward (vertically). This may allow the wedges to freely retract off the taper of the load ring, or the outer angled surface of the shoulder, that is on the casing head.

The connector may include a secondary means of retracting the locking segments in case they do not fully disengage. Each wedge may be coupled to a retracting bolt housed inside a retracting nut, which may be attached to the outer housing. To retract the wedges (individually), a wrench, a socket, an impact, etc. can be used to loosen the retracting nut which will react with a stop shoulder, or head, on the retracting bolt, resulting in pulling (retracting) the wedges outward and fully unlocking the connector.

The retracting bolts and wedges may thread together with a left-handed thread and the retracting nuts may thread to the outer housing 38 utilizing a right-handed thread, or vise versa. This opposite direction of threads may eliminate the opportunity of the retracting bolts and wedges to become unthreaded.

In this manner, the surface connector 10 of the present invention will not only speed up the operation of connecting the BOP 14 to the well tubing 16, but it may also decrease the safety risk of having personnel under the BOP 14 making up a bolted flange connection.

Figure 9:
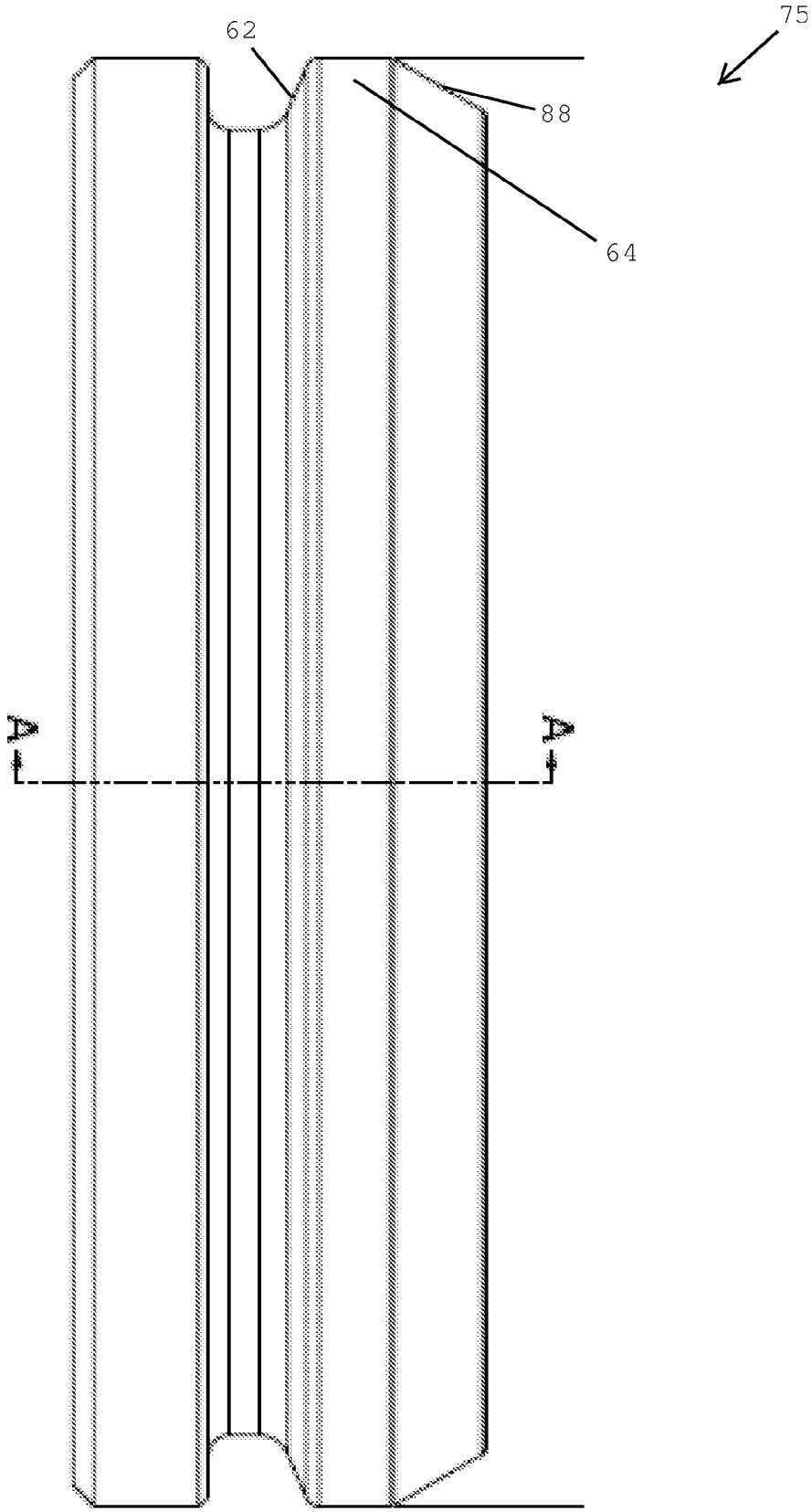
FIG. 9 illustrates an elevation view of a particular embodiment of a load ring utilizing certain aspects of the present inventions.
Figure 10:
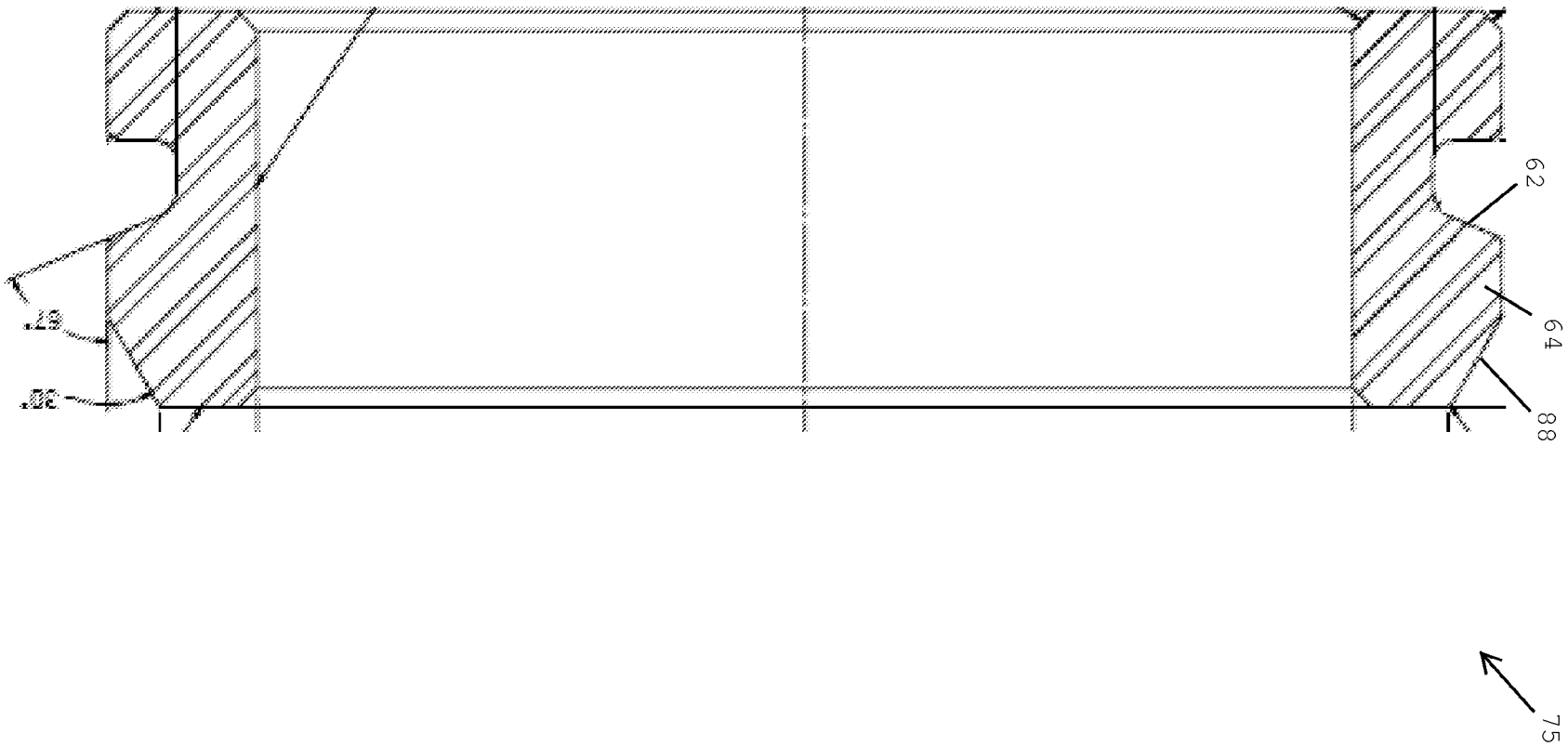
FIG. 10 illustrates a section view of the load ring of FIG. 9.

FIG. 9 and FIG. 10 show one specific example of the load ring 75. The outer angled surface 62, the shoulder 64, and the upper sloped surface 88 are shown. As shown, the outer angled surface 62 is at about sixty seven degrees from the vertical. As also shown, the upper sloped surface 88 is at about thirty degrees from the vertical. In this embodiment, the load ring 75 may be constructed from AISI 4130 75KSI grade, or higher, steel.

Figure 11:
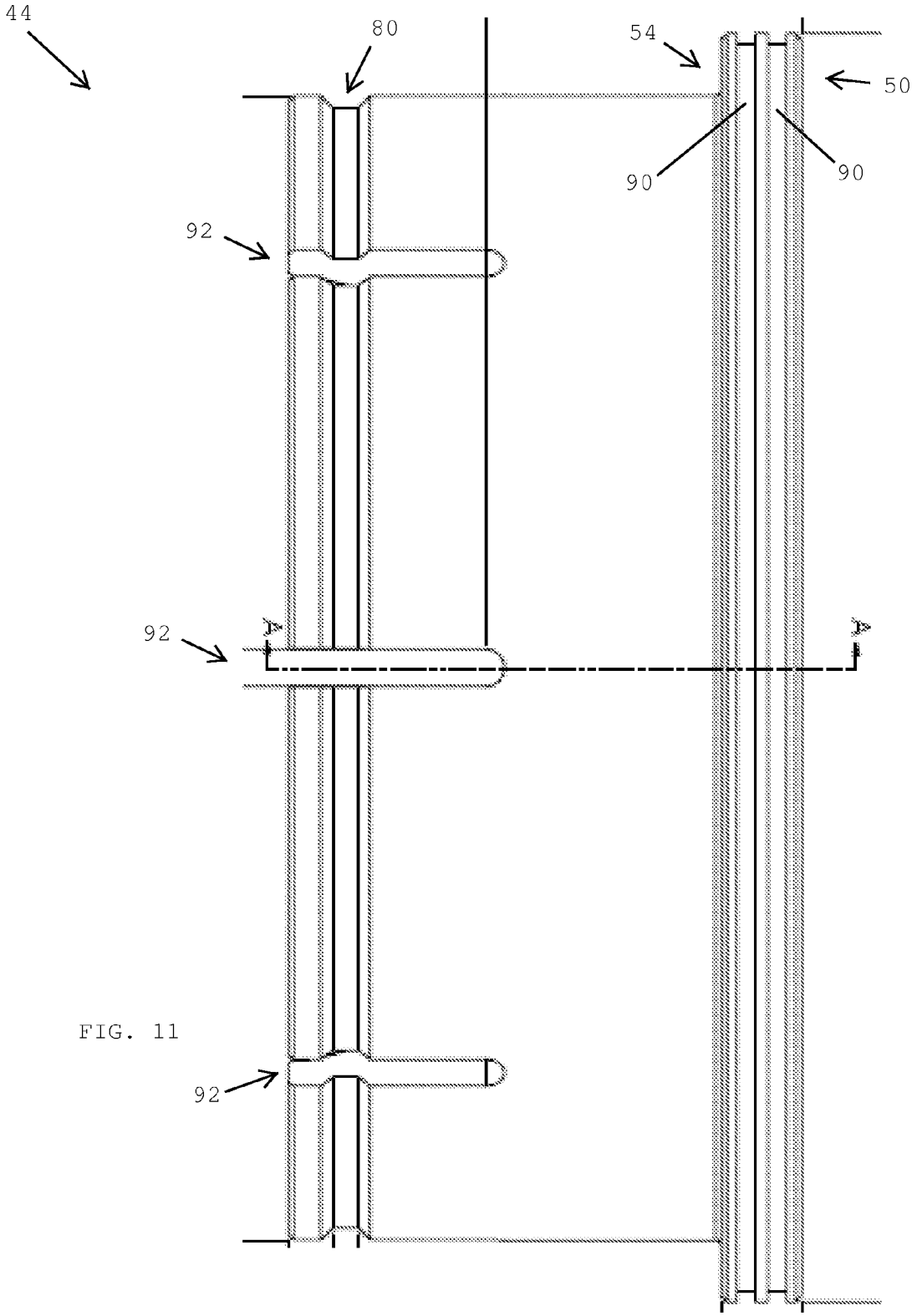
FIG. 11 illustrates an elevation view of a particular embodiment of a tubular piston utilizing certain aspects of the present inventions.
Figure 12:
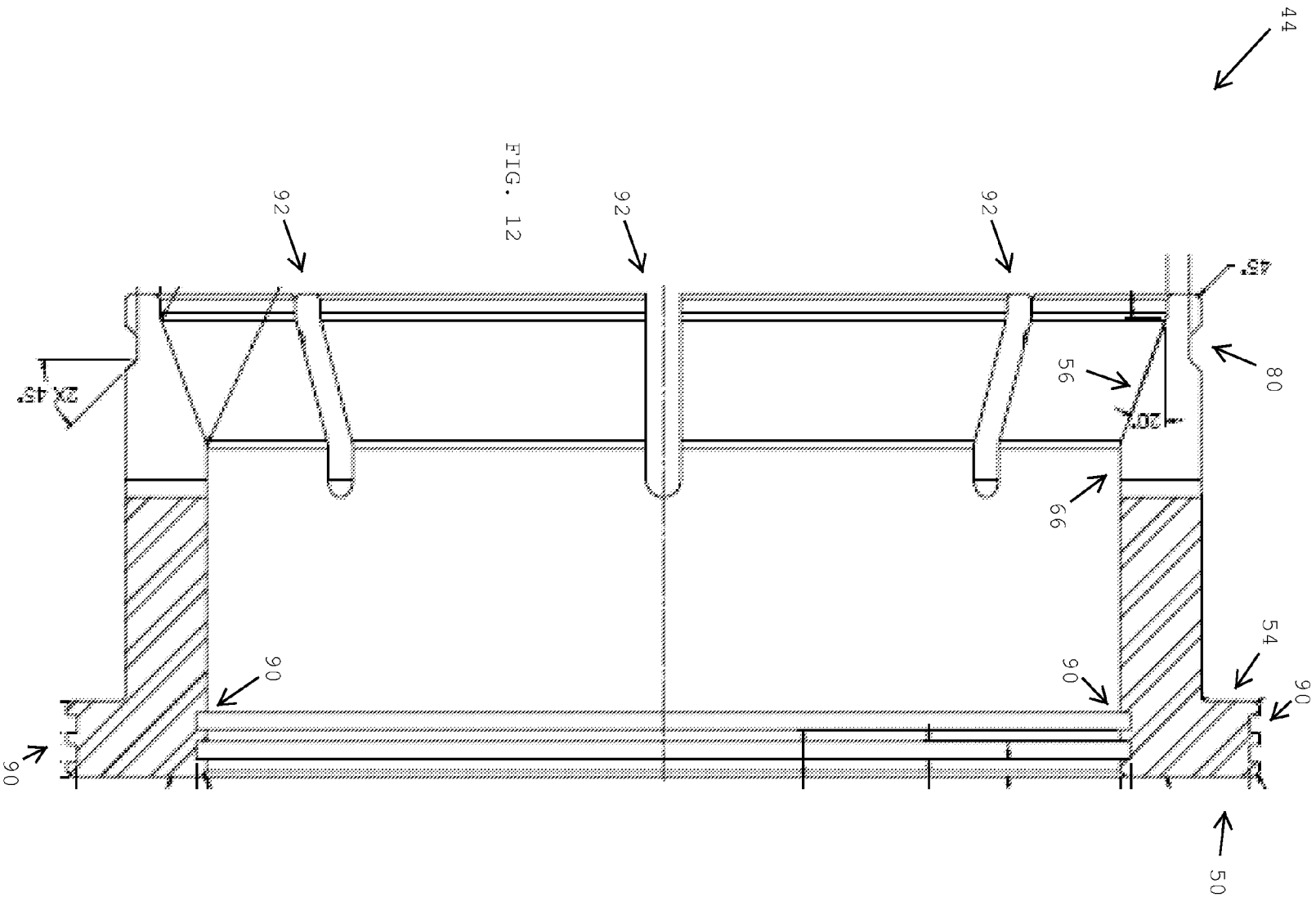
FIG. 12 illustrates a section view of the tubular piston of FIG. 11.

FIG. 11 and FIG. 12 show one specific example of the tubular piston 44. The locking surface 50, the unlocking surface 54, the inner sloping surface 56, the longitudinally flat inner surface 66, and the recess 80 are shown. As shown, the inner sloping surface 56 is at about twenty degrees from the vertical. As also shown, the recess 80 is formed by two sidewalls, each at about forty five degrees from the vertical. In addition, inner and outer seal grooves 90 are shown, which may accept O-ring seals to seal the piston 44 with the adapter 12 and outer housing 38, respectively, to contain the pressurized hydraulic fluid, and thereby ensure proper operation of the hydraulically operated locking segment 40. The piston 44 may also include one or more notches 92 to allow the piston 44 to slide past the retracting bolts 72. In this embodiment, the piston 44 may be constructed from AISI 4130 75KSI grade, or higher, steel.

Figure 13:
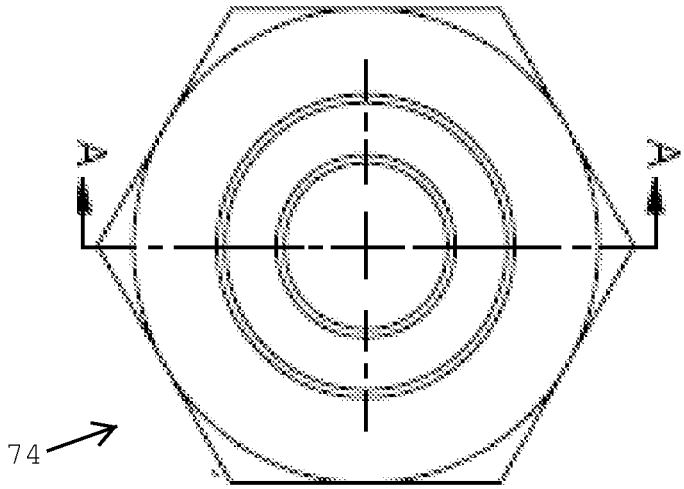
FIG. 13 illustrates a plan view of a particular embodiment of a retracting nut utilizing certain aspects of the present inventions.
Figure 14:
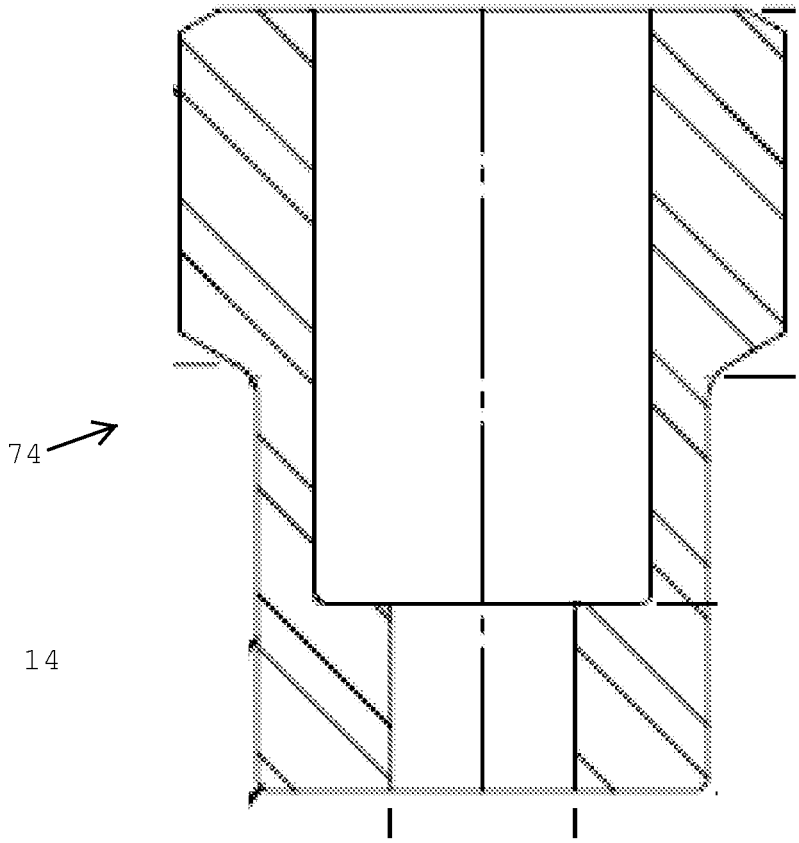
FIG. 14 illustrates a section view of the retracting nut of FIG. 13.
Figure 15:
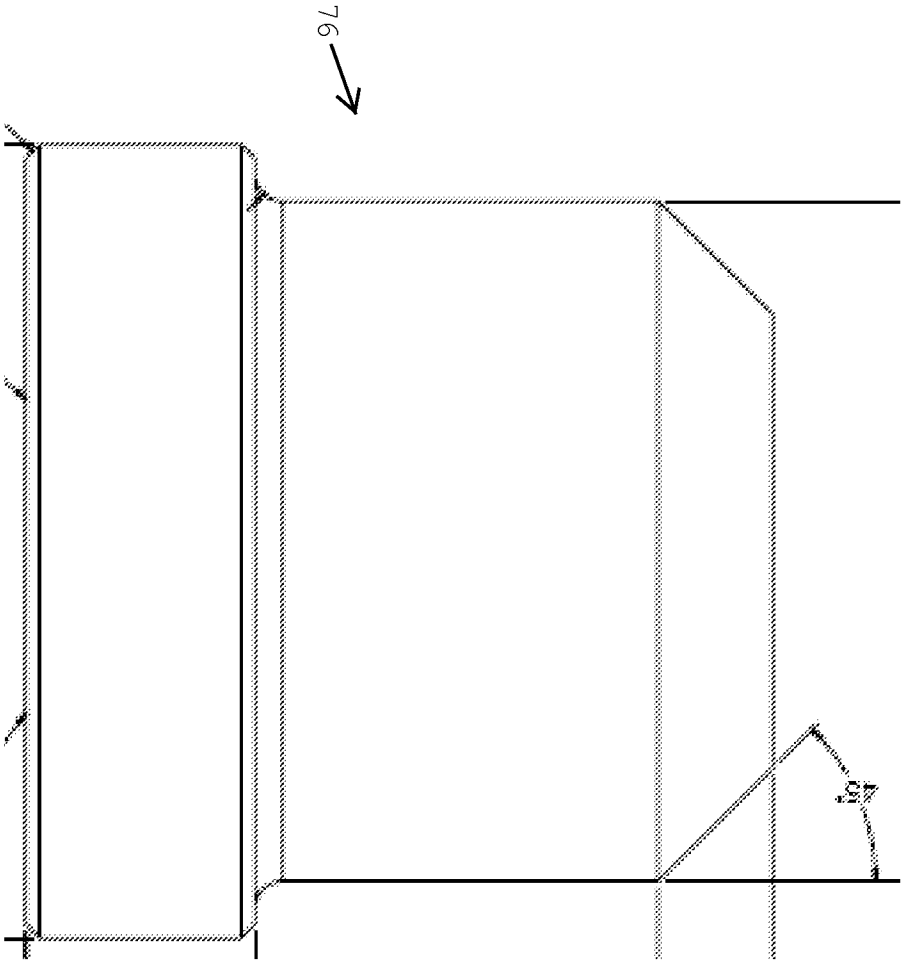
FIG. 15 illustrates a an elevation view of a particular embodiment of a retaining pin utilizing certain aspects of the present inventions.

FIG. 13 and FIG. 14 show one specific example of the retracting nut 74. FIG. 15 shows one specific example embodiment of the retaining pin 76. As shown, a distal end of the retaining pin 76 is formed by two sidewalls, each at about forty five degrees from the vertical, thereby configured to slidably engage the piston 44 and mate into the recess 80 of the piston 44. In this embodiment, the retaining pin 76 may be constructed from AISI 4130 75KSI grade, or higher, steel.

Figure 16:
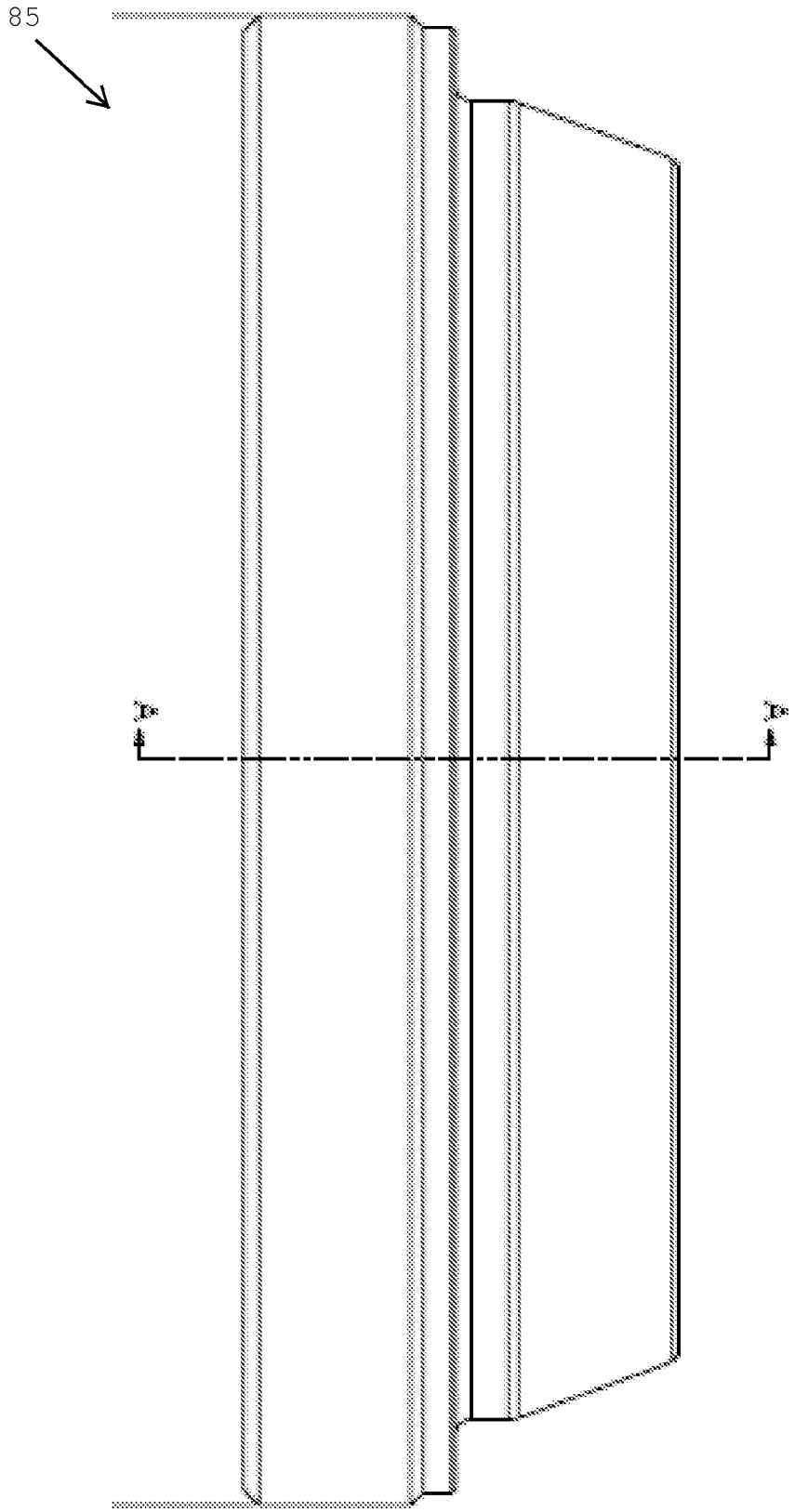
FIG. 16 illustrates an elevation view of a particular embodiment of a guide funnel utilizing certain aspects of the present inventions.
Figure 17:
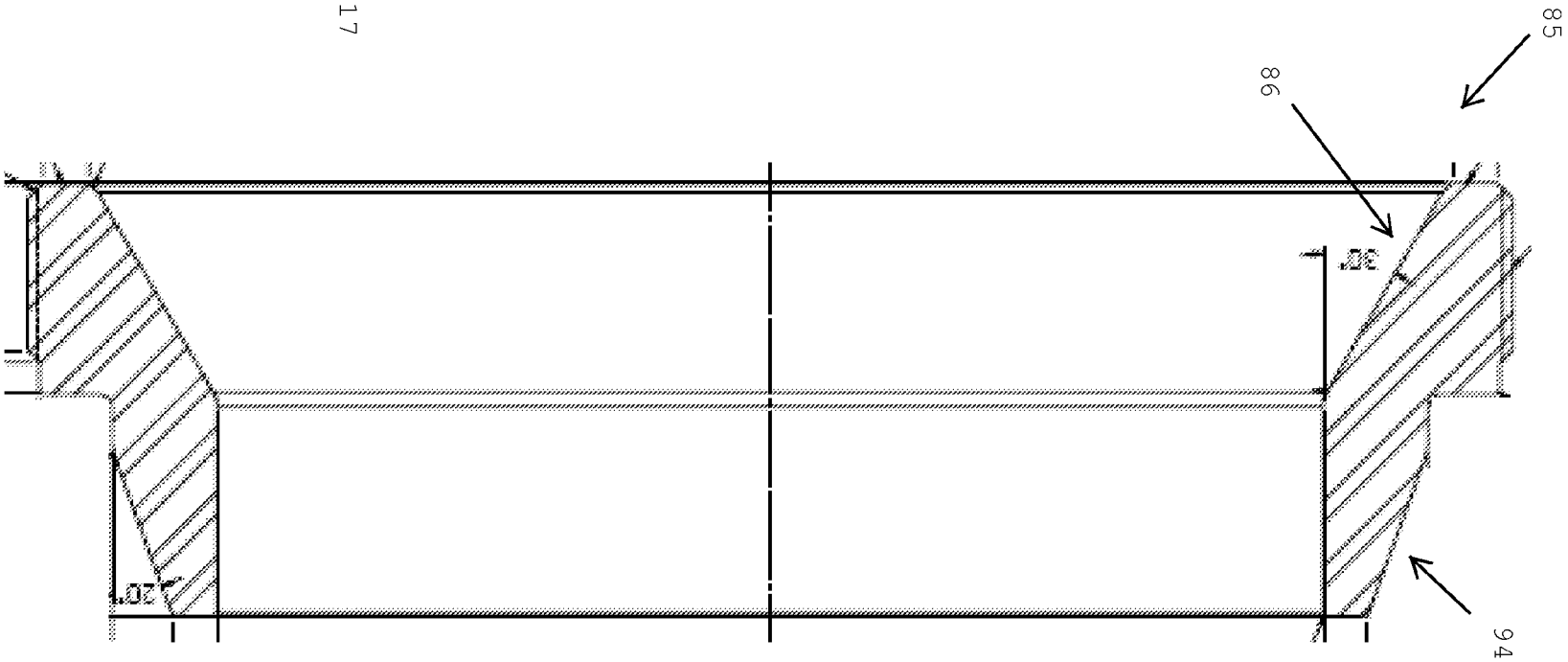
FIG. 17 illustrates a section view of the guide funnel of FIG. 16.

FIG. 16 and FIG. 17 show one specific example of the guide funnel 85. The lower sloped surface 86 is shown. As shown, the lower sloped surface 86 is at about thirty degrees from the vertical, thereby configured to engage the upper sloped surface 88 of the load ring 75, or shoulder 64. In addition, the guide funnel 85 may include a upper sloped surface 94 at about twenty degrees from the vertical, thereby configured engage the inner sloping surface 56 of the piston 44. As the guide funnel 85 is expected to be threaded, welded, or otherwise firmly secured to the outer housing 38, the upper sloped surface 94 may provide a stop to prevent over-travel of the piston 44. In this embodiment, the guide funnel 85 may be constructed from AISI 4130 75KSI grade, or higher, steel.

Figure 18:
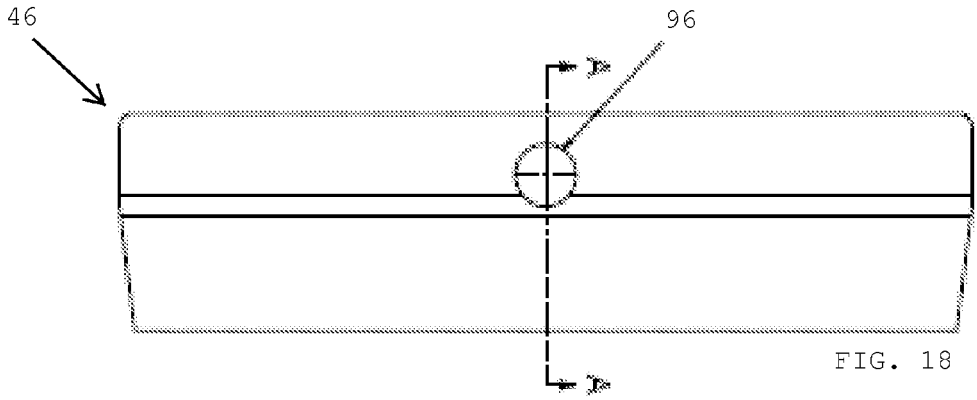
FIG. 18 illustrates an elevation view of a particular embodiment of a wedge utilizing certain aspects of the present inventions.
Figure 19:
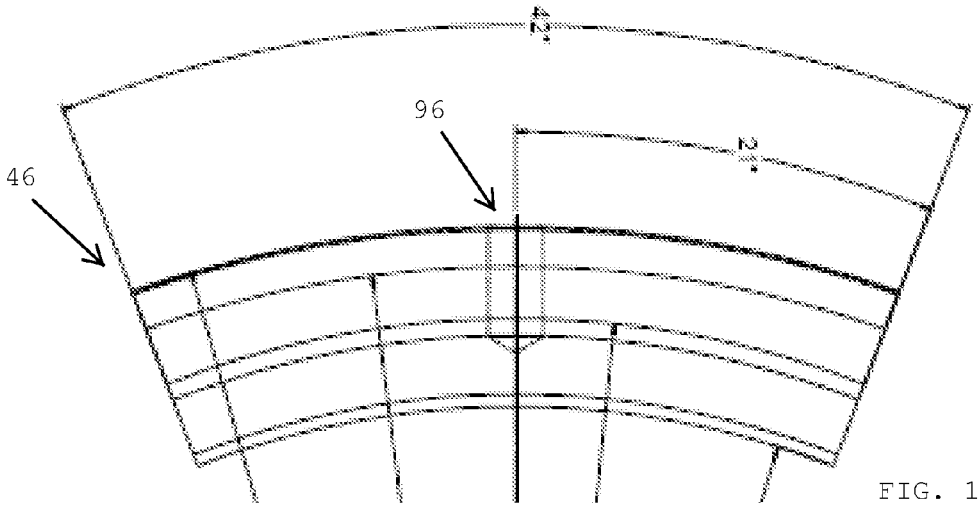
FIG. 19 illustrates a plan view of the wedge of FIG. 18.
Figure 20:
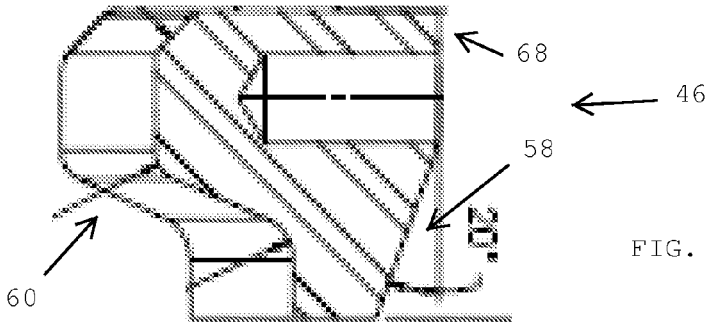
FIG. 20 illustrates a perspective view of the wedge of FIG. 18.

FIG. 18, FIG. 19, and FIG. 20 show one specific example of the wedge 46. The outer sloping surface 58, the inner angled surface 60, and the longitudinally flat outer surface 68 are shown. As shown, the outer sloping surface 58 is at about twenty degrees from the vertical, thereby configured engage the inner sloping surface 56 of the piston 44. As also shown, the flat outer surface 68 is vertical, thereby configured engage the longitudinally flat inner surface 66 of the piston 44. In this embodiment, the wedge 46 may be constructed from AISI 4140 110KSI grade, or higher, steel. As shown, the wedges 46 may be arcuate and occupy about forty two degrees of the piston's 44 circumference. Additionally, at a midpoint, near about twenty one degrees, the wedge 46 may include a threaded hole to receive the retracting bolt 72 therein.

Other and further embodiments utilizing one or more aspects of the inventions described above can be devised without departing from the spirit of Applicant's invention. For example, other dimensions, angles, and/or materials might be used. Further, the various methods and embodiments of the present invention can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A connector to secure a blow out preventer to tubing of a well, the connector comprising:

an adapter configured to be secured to the blow out preventer;

wherein the connector is configured to secure the adapter to the tubing and provide, within fifteen minutes, a seal between the blow out preventer and the tubing;

wherein the connector includes both a hydraulically operated locking segment and a mechanical locking segment, and wherein both locking segments are configured to be transitioned from a fully retracted position to a fully locked position within fifteen minutes; and wherein the connector includes a load ring configured to be threaded onto the tubing, the load ring providing a shoulder at a distal end of the tubing, and wherein the hydraulically operated locking segment engages the shoulder to provide the seal.

2. The connector of claim 1, wherein the hydraulically operated locking segment includes a tubular piston that moves longitudinally between the fully retracted position and the fully locked position and a plurality of wedges positioned around the piston, and wherein the longitudinal movement of the piston drives the wedges radially inward to engage the shoulder, thereby providing the seal.

3. A method of securing a blow out preventer to tubing of a well, the method comprising the steps of:

A lowering a connector connected to the blow out preventer onto the tubing;

B pressurizing a hydraulically operated locking segment of the connector, thereby causing the hydraulically operated locking segment to move from a fully retracted position to a fully locked position, and thereby providing a seal between the blow out preventer and the tubing; and C retaining the hydraulically operated locking segment in the fully locked position utilizing a mechanical locking segment;

wherein step B comprises longitudinally moving a tubular piston of the hydraulically operated locking segment between the fully retracted position and the fully locked position, thereby driving a plurality of wedges positioned around the piston radially inward to engage a shoulder of the tubing, thereby providing the seal.

4. The method of claim 3, further including, before step A, the step of threading a load ring onto the tubing, thereby providing the shoulder to the tubing.

5. The method of claim 3, further including the step of reducing the pressure applied to the hydraulically operated locking segment, wherein the wedges engage the piston along vertically straight surfaces as the hydraulically operated locking segment is in the fully locked position, thereby maintaining the hydraulically operated locking segment in the fully locked position with reduced pressure applied to the hydraulically operated locking segment.

6. A method of securing a blow out preventer to tubing of a well, the method comprising the steps of:

A lowering a connector connected to the blow out preventer onto the tubing;

B pressurizing a hydraulically operated locking segment of the connector, thereby causing the hydraulically operated locking segment to move from a fully retracted position to a full locked position, and thereby providing a seal between the blow out preventer and the tubing; and C retaining the hydraulically operated locking segment in the fully locked position utilizing a mechanical locking segment;

wherein step C comprises rotating a plurality of retaining nuts positioned about a circumference of the connector, thereby driving a plurality of retaining pins into a plurality of recesses in a tubular piston of the hydraulically operated locking segment, thereby retaining the hydraulically operated locking segment in the fully locked position.

7. A method of securing a blow out preventer to tubing of a well, the method comprising the steps of:

A lowering a connector connected to the blow out preventer onto the tubing;

B pressurizing a hydraulically operated locking segment of the connector, thereby causing the hydraulically operated locking segment to move from a fully retracted position to a fully locked position, and thereby providing a seal between the blow out preventer and the tubing; and C retaining the hydraulically operated locking segment in the fully locked position utilizing a mechanical locking segment;

wherein step A comprises— threading a load ring onto the tubing, the load ring providing a shoulder at a distal end of the tubing, lowering the connector onto the tubing, with the blow out preventer and the tubing misaligned by between five and ten degrees, and aligning the blow out preventer and the tubing;

step B comprises— longitudinally moving a tubular piston of the hydraulically operated locking segment between the fully retracted position and the fully locked position, thereby driving a plurality of wedges positioned around the piston radially inward to engage a shoulder of the tubing, thereby providing the seal, and wherein the seal is a metal to metal seal configured to withstand ten thousand pounds per square inch of pressure; and step C comprises— driving a plurality of retaining pins into a plurality of recesses in a tubular piston of the hydraulically operated locking segment, thereby retaining the hydraulically operated locking segment in the fully locked position, and reducing the pressure applied to the hydraulically operated locking segment to atmospheric pressure; and wherein steps A, B, and C are performed above sea level and within fifteen minutes.

8. A connector to secure a blow out preventer to tubing of a well, the connector comprising:

an adapter configured to be secured to the blow out preventer; and a hydraulically operated locking segment to force the adapter toward the tubing, thereby providing a seal between the blow out preventer and the tubing; and a mechanical locking segment configured to retain the hydraulically operated locking segment in a fully locked position once hydraulic pressure is decreased;

wherein the connector includes a load ring configured to be threaded onto the tubing, the load ring providing a shoulder at a distal end of the tubing, and wherein the hydraulically operated locking segment engages the shoulder to provide the seal.

9. The connector of claim 8, wherein the hydraulically operated locking segment includes a concentric tubular piston that moves longitudinally between a fully retracted position and the fully locked position and a plurality of wedges positioned around the piston, and wherein the longitudinal movement of the piston drives the wedges radially inward to engage the shoulder, thereby providing the seal.

10. The connector of claim 9, wherein the mechanical locking segment comprises a plurality of retaining pins each configured to slide into one of a plurality of recesses in the piston, when the piston is in the fully locked position, thereby holding the piston in the fully locked position even with a loss of hydraulic pressure.

* * * * *